US005321411A

United States Patent [19]

Tsukamoto et al.

[11] Patent Number: 5,321,411

[45] Date of Patent: Jun. 14, 1994

[54] PLANAR ANTENNA FOR LINEARLY POLARIZED WAVES

[75] Inventors: Katsuya Tsukamoto; Hirowo Inoue; Kaname Okuno; Toshio Abiko, all of Kadoma, Japan

[73] Assignee: Matsushita Electric Works, Ltd., Osaka, Japan

[21] Appl. No.: 7,811

[22] Filed: Jan. 22, 1993

Related U.S. Application Data

[63] Continuation of Ser. No. 636,256, Dec. 31, 1990, abandoned.

[30] Foreign Application Priority Data

Jan. 26, 1990 [JP] Japan ..... 2-17137
Jun. 26, 1990 [JP] Japan ..... 2-167841
Jun. 26, 1990 [JP] Japan ..... 2-167842

[51] Int. Cl.[5] ..... H01Q 1/38; H01Q 13/10
[52] U.S. Cl. ..... 343/700 MS; 343/770
[58] Field of Search ..... 343/700 MS, 786, 767, 343/770, 829, 845, 846, 847, 848, 769

[56] References Cited

U.S. PATENT DOCUMENTS 4,259,670 3/1981 Schiavone ..... 343/829
4,429,313 1/1984 Muhs, Jr. et al. ..... 343/771
4,443,802 4/1984 Mayes ..... 343/729
4,475,107 10/1984 Makimoto et al. ..... 343/700 MS
4,614,947 9/1986 Rammos ..... 343/786
4,626,865 12/1986 Rammos ..... 343/786
4,761,654 8/1988 Zaghloul ..... 343/700 MS
4,816,835 3/1989 Abiko et al. ..... 343/700
4,827,276 5/1989 Fukuzawa et al. ..... 343/786
4,851,855 7/1989 Tsukamoto et al. ..... 343/700 MS
4,857,938 8/1989 Tsukamoto et al. ..... 343/700 MS
4,899,162 2/1990 Bayetto et al. ..... 343/700
4,922,263 5/1990 Dubost et al. ..... 343/797
4,929,959 5/1990 Sorbello et al. ..... 343/700 MS
4,977,406 12/1990 Tsukamoto et al. ..... 343/700
5,005,019 4/1991 Zaghloul et al. ..... 343/700
5,025,264 6/1991 Stafford ..... 343/770

OTHER PUBLICATIONS

Ito et al., "Planar Antennas for Satellite Reception", IEEE Transactions on Broadcasting, vol. 34, No. 4, Dec. 1988, pp. 457–464.

*Primary Examiner*—Donald Hajec
*Assistant Examiner*—Hoanganh Le
*Attorney, Agent, or Firm*—Burns, Doane, Swecker & Mathis

[57] ABSTRACT

A planar antenna for linearly polarized waves includes a grounding conductor plate, a power supply circuit plate having a pattern of power supplying circuit of conductor strips each including power supply terminals, and a radiation plate having apertures forming radiation elements, the respective plates being arranged sequentially with an insulating layer interposed between adjacent ones of the plates to separate them to be independent of one another through a predetermined interval, while arranging the power supplying terminals of the power supplying circuit pattern as well as the apertures in the radiation plate so that the respective power supply terminals terminate to be within a contour of the apertures, in a top plan view, whereby the planar antenna makes it possible to receive at a high gain the linearly polarized waves over a wide band.

7 Claims, 6 Drawing Sheets

PLANAR ANTENNA FOR LINEARLY POLARIZED WAVES

This application is a continuation of application Ser. No. 07/636,256, filed Dec. 31, 1990 now abandoned.

BACKGROUND OF THE INVENTION

This invention relates to planar antennas and, more particularly, to a planar antenna capable of receiving linearly polarized waves at a high gain over a wide band.

The planar antenna of the kind referred to are effectively utilized in receiving the linearly polarized waves transmitted with a relatively wide band utilized from geostationary broadcasting and communication satellites launched into cosmic space.

DESCRIPTION OF RELATED ART

Parabolic antennas erected on the roof or the like positions of house buildings have been generally widely utilized as the antenna for receiving radio waves transmitted from the satellites, but the parabolic antennas have been defective in that they are susceptible to strong wind to easily fall down due to their bulky three dimensional structure so that additional means for stably supporting them will have to be employed, and that such supporting means further requires high mounting costs and still troublesome installation labor.

In attempt to eliminate these problems of the known parabolic antennas, there has been suggested in U.S. Pat. No. 4,475,107 to T. Makimoto et al. a planar antenna which is flattened in the entire configuration, according to which the structure can be much simplified and it is made possible to directly mount the antenna on an outer wall or the like position of the house buildings so as to be made inexpensive. Further, prior to the present invention, the present inventors K. Tsukamoto et al. have suggested as disclosed in U.S. Pat. No. 4,851,855 a planar antenna in which power supply circuit and radiation circuit are coupled electromagnetically to each other rather than being brought into direct contact with each other, for supplying a power from the power supply circuit to the radiation circuit, while both circuits as well as a grounding conductor plate are mutually separated with a space retaining means. With this arrangement, the power supply circuit can be also disposed in the space thus retained, and the insertion loss can be reduced effectively.

According to these U.S. Pat. No. 4,851,855, it is possible to reduce the insertion loss of the planar antennas and to improve them in the assembling ability in contrast to any known planar antennas. In this patent, however, the radiation circuit comprises slots of square, circular or other shape and patch elements respectively disposed in each of the slots in the form of a floating island so that a highly precise etching will be required therefor with required etching pattern of the radiation plate made much complicated, and there have arisen such problems that manufacturing fluctuation becomes large to lower the yield or resultant products and required manufacturing costs are generally elevated. In addition, in the planar antenna of the U.S. patent, in particular, there has been a drawback that applicable radio wave band is relatively narrow so that, while they may be effectively utilized with respect to the broadcasting satellite the transmission power of which is relatively large, the reception efficiency has to be lowered when the transmission power is relatively small in such case as the communication satellite. Further, similar teachings to that of this U.S. patent has been disclosed in U.S. Pat. No. 4,761,654 to A. L. Zaghloul and in U.S. Pat. No. 4,922,263 to G. Dubost et al. However, they still involve substantially the same problems as in the above.

In order to solve the foregoing problems, the present inventors K. Tsukamoto et al. have suggested prior to the present invention, as disclosed in U.S. patent application Ser. No. 07/509,820, a planar antenna in which the radiation circuit is provided with many apertures which are generally star-shaped, the power supply terminals of the power supply circuit are disposed to oppose respectively each of the star-shaped apertures, and the radiation and power supply circuits are assembled with the grounding conductor plate as separated from one another. According to this planar antenna, it is made possible to receive the circularly polarized waves at a high gain over a wide band. However, there has not been suggested as yet a planar antenna which is capable of receiving over a wide band and at a high gain the linearly polarized waves not only from the broadcasting satellite but also from the communication satellite, and it has been a demand that such planar antenna is developed.

SUMMARY OF THE INVENTION

A primary object of the present invention is, therefore, to provide a planar antenna capable of receiving the linearly polarized waves over a wide band and at a high gain.

It is another object of the present invention to provide a planar antenna which can operate at a high efficiency so as to be able to restrain the power supply loss to be the minimum, so that the linearly polarized waves transmitted not only from the broadcasting satellite but also from the communication satellite of the relatively smaller transmission power can be received, so as to be high in the utility for various purposes.

Still another object of the present invention is to provide a planar antenna which has a low loss interposition disposed as a dielectric member between the respective radiation plate, power supply circuit plate and grounding conductor plate, so as to achieve a further improved efficiency.

According to the present invention, these objects can be realized by means of a planar antenna for linearly polarized waves, which comprising a grounding conductor plate, a power supply circuit plate having thereon a power supply circuit pattern including power supply terminals and disposed to be separated from the grounding conductor plate by a predetermined space so as to have an insulating layer interposed with respect to the grounding conductor plate, and a radiation plate having therein apertures disposed as radiation elements respectively coupled electromagnetically with each of the power supply terminals of the power supply circuit plate and disposed to be separated from the power supply circuit plate by a predetermined space so as to have an insulating layer interposed with respect to the power supply circuit plate, wherein the power supply terminals of the power supply circuit plate are disposed to terminate within a contour of the respective apertures in the top plan view.

According to the present invention, further, there is provided a planar antenna in which the power supply circuit pattern of the power supply circuit plate having the power supply terminals to be electromagnetically coupled with the apertures of the radiation plate is made smaller in conductor strip width of the pattern at portions adjacent to the terminals to be electromagnetically coupled to the apertures of the radiation plate.

Further according to the present invention, there can be provided a planar antenna which is made to be of a low loss by means of an insulating sheet including many hollow swellings made to closely stand and sealing tightly therein air as a dielectric member, the insulating sheet being disposed between the respective radiation, power supply circuit and grounding conductor plates.

Other objects and advantages of the present invention will be made clear in following description of the invention detailed with reference to accompanying drawings.

While the present invention shall now be explained with reference to the embodiments shown in the accompanying drawings, it will be appreciated that the intention is not to limit the present invention only to these embodiments shown but rather to include all alterations, modifications and equivalent arrangements possible within the scope of appended claims of the present invention.

DETAILED DESCRIPTION OF THE PREFERRED EMBODIMENTS

Figure 1:
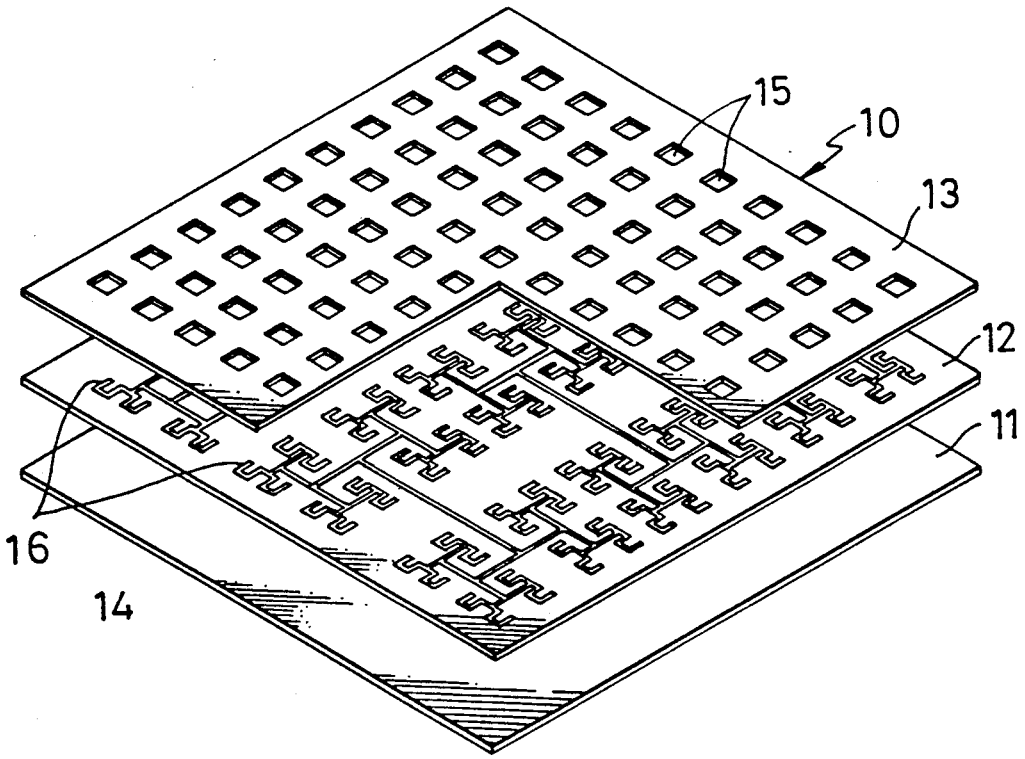
FIG. 1 is a perspective view as disassembled of the planar antenna for linearly polarized waves in an embodiment of the present invention, with a portion shown as removed.
Figure 2:
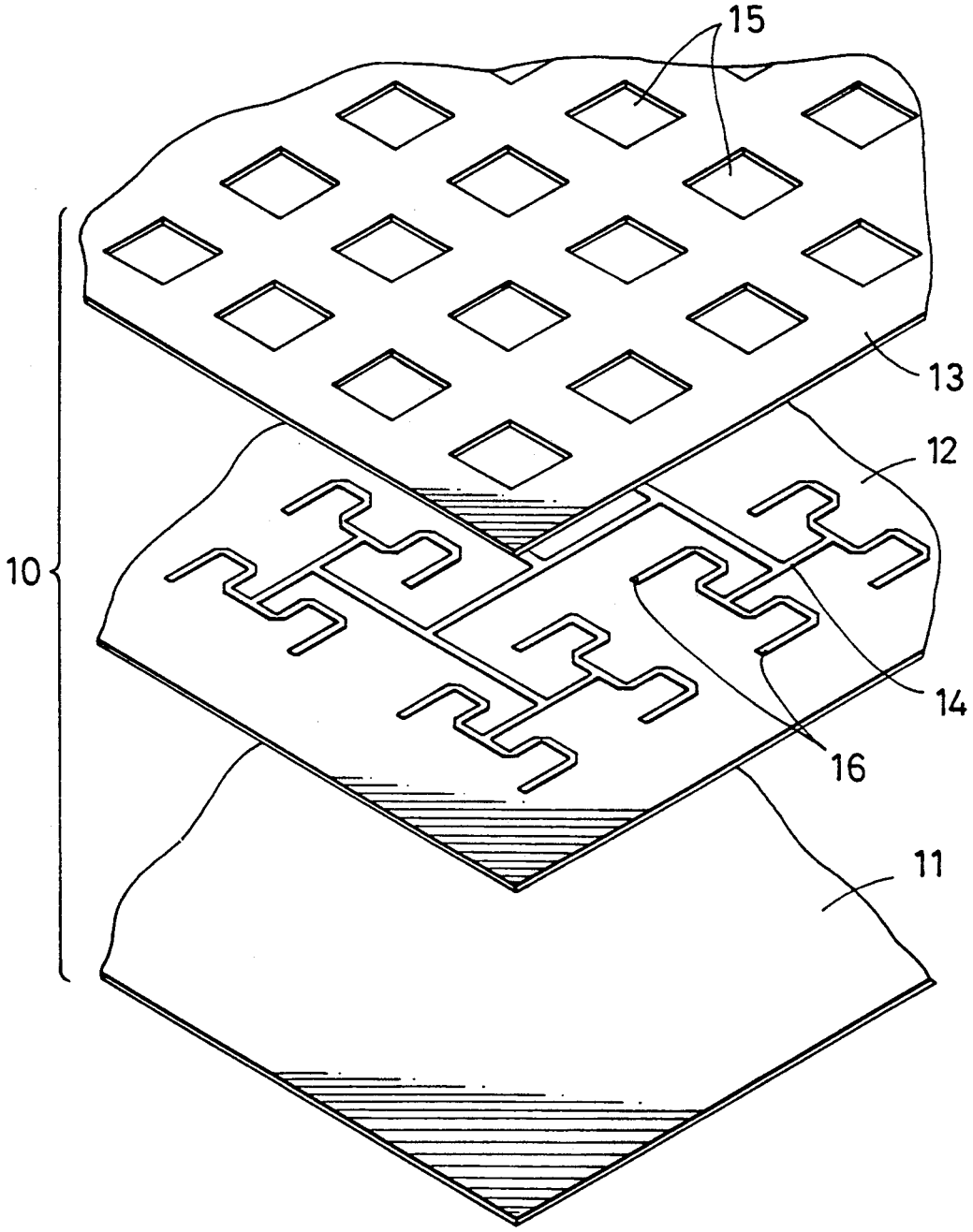
FIG. 2 is a fragmentary perspective view as magnified of the planar antenna of FIG. 1.
Figure 3:
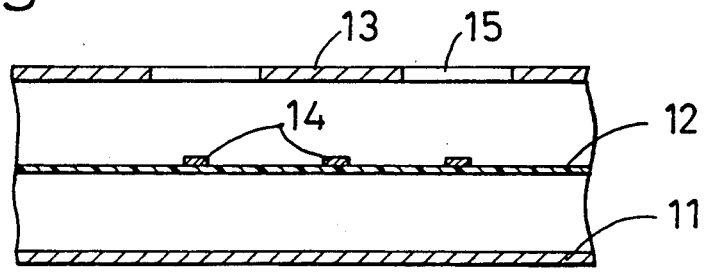
FIG. 3 is a fragmentary sectioned view as magnified of the planar antenna of FIG. 1.

Referring to FIGS. 1 to 3 showing the planar antenna for linearly polarized waves in an embodiment according to the present invention, the planar antenna 10 generally comprises a grounding conductor plate 11, a power supply circuit plate 12, and a radiation plate 13. The grounding conductor plate 11 can be formed with an aluminum plate of a thickness of about 2 mm, for example, while such other electrically conducting material as copper, silver, astatine, iron, gold or the like may also be utilized. In the power supply circuit plate 12, a power supply circuit pattern 14 of conductor strips of such conducting material as copper, aluminum, silver, astatine, iron, gold or the like, preferably, is formed by means of an etching on a plastic sheet which is formed with polyethylene, polypropylene, polyester, acryl, polycarbonate, ABS resin or PVC resin alone or in a mixture of two or more, preferably. The radiation plate 13 is formed with an aluminum plate of a thickness of about 0.4 mm, preferably, with a plurality of apertures 15 formed as radiation elements by means of punching.

The apertures 15 in the radiation plate 13 are formed to have a square-shaped contour (see FIG. 5) and are arranged in column and line relationship. The power supply circuit pattern 14 on the power supply circuit plate 12 is so formed as to dispose power supply terminals 16 of the pattern 14 respectively at a position aligned with each of the apertures 15 of the radiation plate 13 so that, in the present instance, the power supply terminal 16 will extend beyond the center of the aperture 15 in plan view but terminate at a position within the square-shaped contour, without exceeding the contour, whereby the power supply terminals 16 are enabled to be optimumly coupled electromagnetically to the apertures 15 and hence the linearly polarized waves from the satellite are enabled to be effectively received. Further, a highly efficient antenna gain may be attained when the apertures 15 are formed by the punching in 32 columns and 32 lines at intervals of 20 mm, for example.

Figure 4:
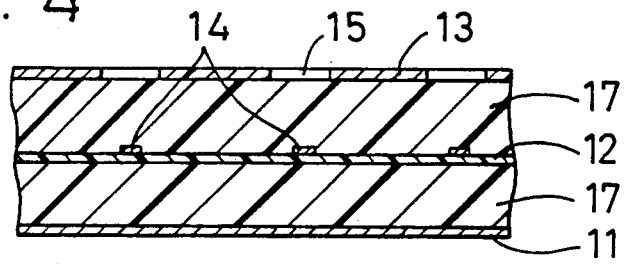
FIG. 4 is a fragmentary sectioned view as magnified of the planar antenna of FIG. 1 but in another aspect thereof.
Figure 5:
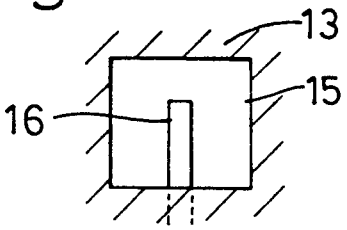
FIG. 5 is an explanatory view for the relationship between the aperture and the power supply terminal in the planar antenna of FIG. 1.
Figure 6:
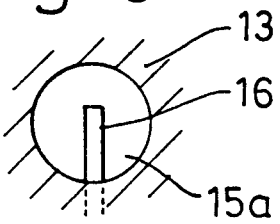
FIG. 6 is an explanatory view for the relationship between the aperture and the power supply terminal in another aspect of the planar antenna of FIG. 1.

In the embodiment of FIGS. 1 to 3, the arrangement has been made to interpose the air layer between the respective grounding conductive plate 11, power supply circuit plate 12 and radiation plate 13 for their mutual electric insulation, but such insulation may be similarly achieved by means of such interpositions 17 made of foamed plastic and inserted between the respective plates 11, 12 and 13 as shown in FIG. 4. Further, while the apertures 15 of the radiation plate 13 should be formed preferably to have the square-shaped contour as shown in FIG. 5 for achieving the highly efficient gain with the aperture area thus enlarged, the radiation plate 13 may be formed to have such circular apertures **15*a* as shown in FIG. 6 to be combined with the power supply terminals 16 which are also disposed to extend beyond the center of the circular apertures 15*a* but to terminate within circular contour of the apertures 15*a*** in the plan view.

Figure 7:
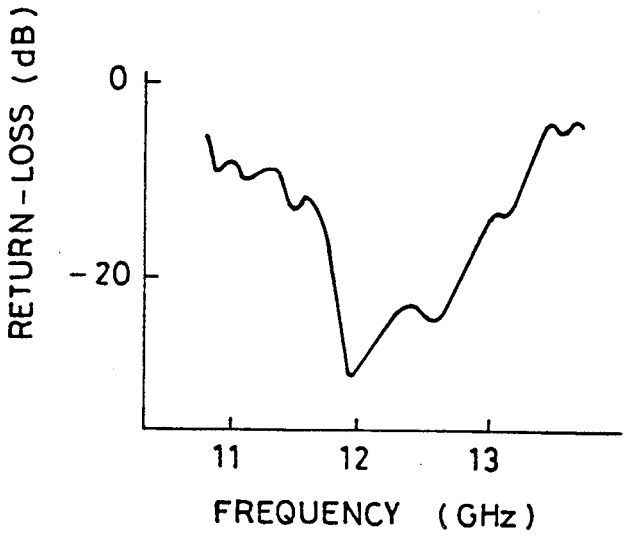
FIG. 7 is a diagram showing the relationship between the frequency and the return loss in the planar antenna of FIG. 1.
Figure 8:
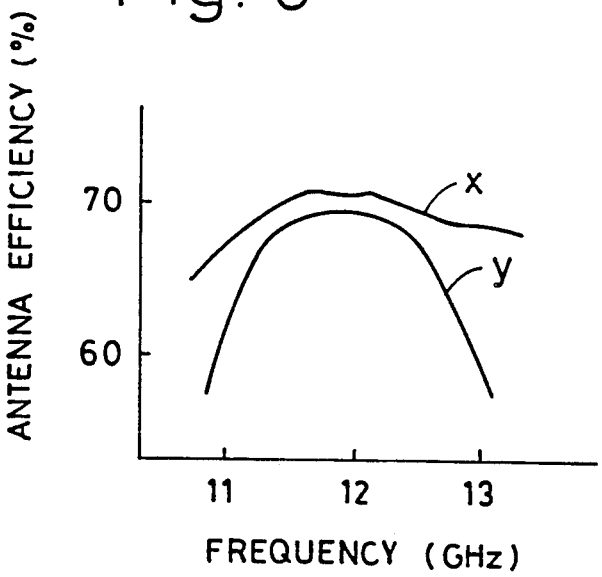
FIG. 8 is a diagram showing the relationship between the frequency and the antenna efficiency in the planar antenna of FIG. 1.

In the planar antenna 10 of the foregoing arrangement, it has been found that the return loss with respect to the frequency is shown to be excellent even when the frequency is around 11 GHz and 13 GHz, as seen in FIG. 7. Further, as shown in FIG. 8 by a curve "x", the antenna efficiency with respect to the frequency is excellent over a range of 11 to 13 GHz, to be better than that of known arrangement as shown by a curve "y".

EXAMPLE 1

First, the square-shaped apertures of 15 mm at each side were formed as being punched through an aluminum plate of 0.5 mm thick and available in the market, so as to be the radiation elements in 32 columns and 32 lines, and thereby the radiation plate was obtained. Next, the power supply circuit plate was prepared by forming the power supply circuit pattern having the power supply terminals for the electromagnetic coupling with the apertures as the radiation elements, on a flexible printed-circuit substrate available in the market, by means of an etching. Further, this power supply circuit plate was mounted on the grounding conductive plate of an aluminum plate of 2 mm thick and available in the market, with a foamed polyethylene sheet of 1 mm thick and available in the market interposed between these plates, the radiation plate was further stacked on the power supply circuit plate with a further foamed polyethylene sheet of 3 mm thick and available in the market as interposed between them, and a planar antenna for the linearly polarized waves was thereby prepared.

It was found that, with the above planar antenna, the antenna efficiency of more than 65% was obtained at least over 11 to 13 GHz.

EXAMPLE 2

Except that the apertures of the radiation plate were made circular instead of the square shape, a planar antenna for the linearly polarized waves was prepared in the same manner as in Example 1. While the antenna efficiency was slightly lower than that of Example 1, this planar antenna could also attain the antenna efficiency of more than 65% over the range of 11 to 13 GHz.

EXAMPLE 3

A planar antenna for the linearly polarized waves was prepared by employing a foamed polyethylene sheet of 2 mm thick in place of the 1 mm thick foamed polyethylene sheet between the radiation plate and the power supply circuit plate in the foregoing Example 1, as well as a foamed polyethylene sheet of 4 mm thick in place of the 3 mm thick foamed polyethylene sheet between the power supply circuit plate and the grounding conductor plate. It was found that, with this arrangement of the planar antenna, the antenna efficiency could be improved substantially by about 3%, and the frequency band could be also widened by 500MHz.

EXAMPLE 4

A planar antenna for the linearly polarized waves was prepared by employing foamed polyethylene sheets of 2 mm thick in place of both the 1 mm thick foamed polyethylene sheet between the radiation and power supply circuit plates and the 3 mm thick foamed polyethylene sheet between the power supply circuit and grounding conductor plates in the foregoing Example 1, and it was also found that this planar antenna could attain the same effect as in the planar antenna of the foregoing Example 1.

EXAMPLE 5

A planar antenna for the linearly polarized waves was prepared in the same manner as in the foregoing Example 1 except for that the radiation plate was formed with a flexible printed-circuit substrate having thereon a conductor film including the apertures formed by means of an etching instead of the punching, and substantially the same effect as in the planar antenna of Example 1 could be attained.

Figure 9:
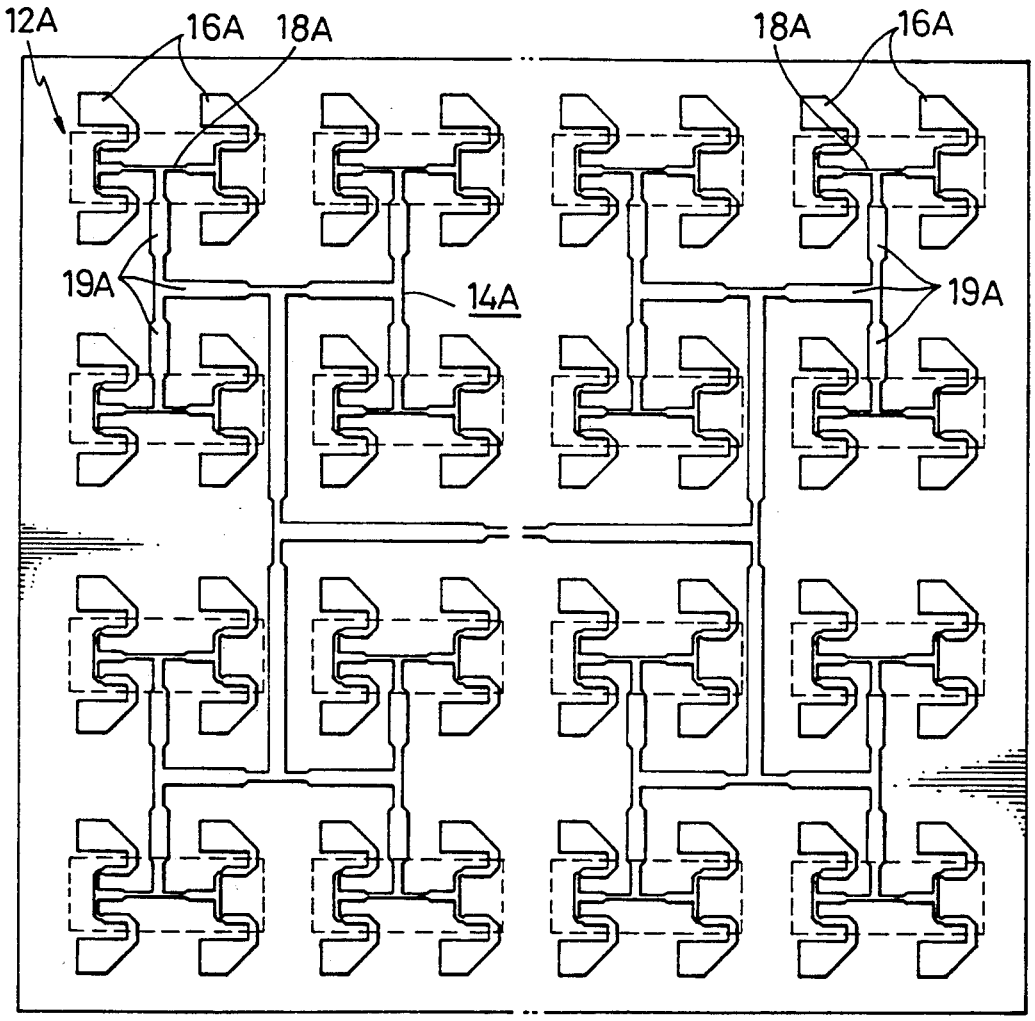
FIG. 9 is a plan view of the power supply circuit pattern in another embodiment of the planar antenna according to the present invention.

According to another feature of the present invention, the planar antenna for the linearly polarized waves is arranged for minimizing the power supply loss in the power supply circuit pattern. Referring to FIG. 9, a power supply circuit pattern 14A formed on a power supply circuit plate 12A by means of, for example, etching is made to be relatively smaller in the conductor strip width in such areas 18A as enclosed by dotted lines in the drawing than that in other areas 19A and power supply terminals 16A, the areas 18A being located adjacent to the power supply terminals 16A to be electromagnetically coupled with the apertures forming the radiation elements in the radiation plate and preferably including at least first and second T-shaped branch portions from the terminals 16A. In this case, the conductor strips of the smaller width in the areas 18A and other conductor strips of relatively larger width are disposed to run in parallel relationship with intervals set to be larger than the smaller width of the conductor strips in the areas 18A.

It has been found that, with the above arrangement of the instant embodiment, an undesirable electromagnetic coupling of the apertures with such other portions of the power supply circuit pattern 14A than the terminals 16A could be restrained to be the minimum. In practice, the planar antenna for the linearly polarized waves of the instant embodiment has shown to be improved in the gain by 0.5 dB, in contrast to the planar antenna for the linearly polarized waves in which the conductor strip width of the power supply circuit pattern 14A is kept substantially the same all over the pattern. It could be also possible to attain a higher antenna efficiency than that in the foregoing embodiment of FIGS. 1 to 3 over such wider band as to be 11 to 13 GHz.

Figure 11:
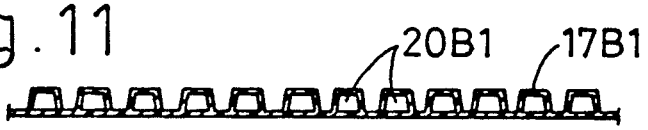
FIG. 11 is a fragmentary sectioned view of the insulating sheet employed in the planar antenna of FIG. 10.
Figure 12:
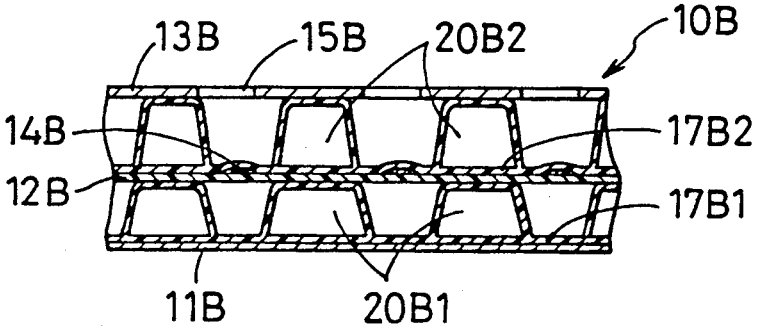
FIG. 12 is a fragmentary sectioned view as magnified of the planar antenna of FIG. 10.
Figure 10:
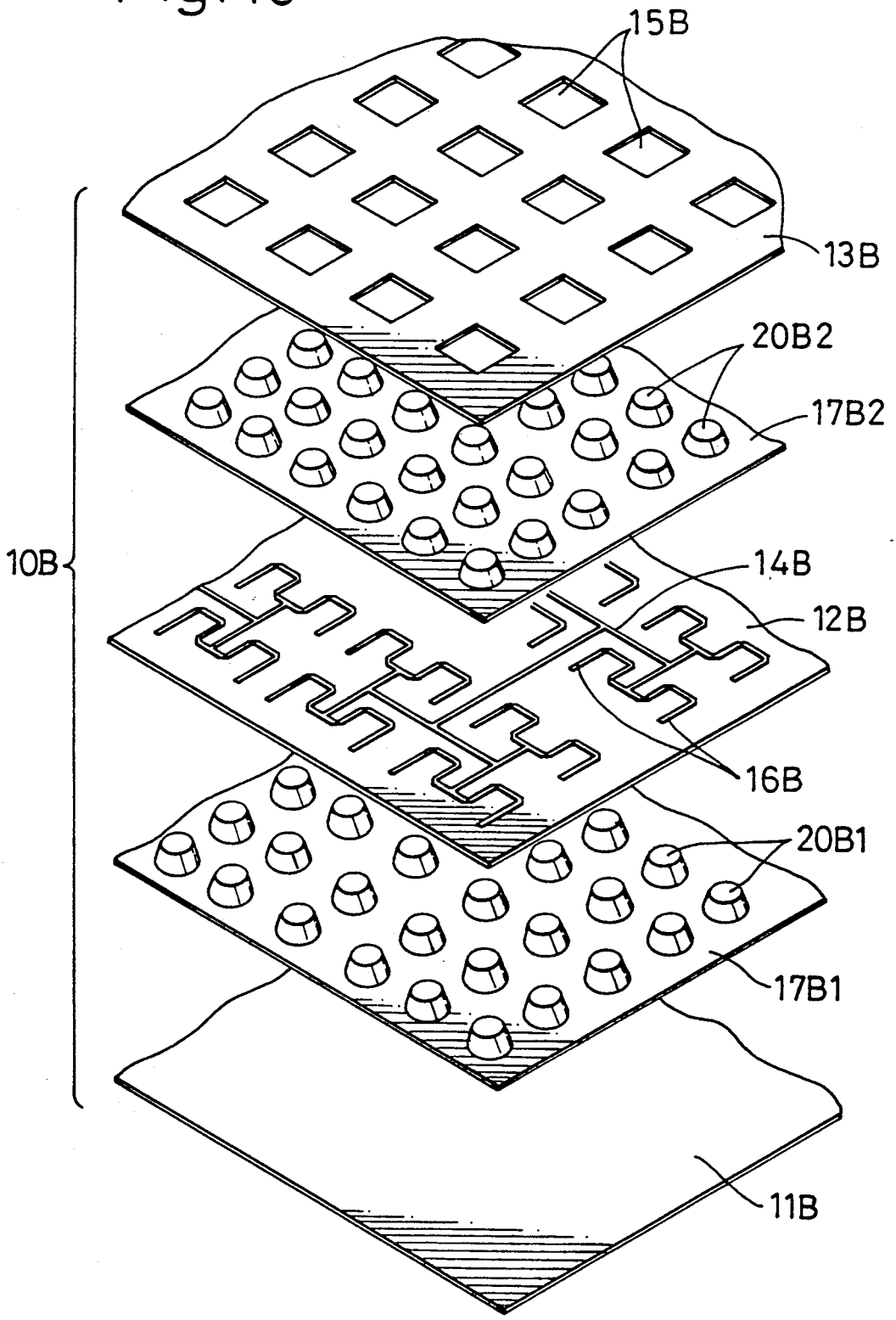
FIG. 10 is a fragmentary perspective view as magnified of the planar antenna in still another embodiment according to the present invention.

According to still another feature of the present invention, it is attempted to improve the antenna efficiency by inserting interpositions showing a low loss between the grounding conductor plate and the power supply circuit plate and between the power supply circuit plate and the radiation plate. Referring to FIGS. 10 to 12, a first insulating sheet 17B1 carrying hollow swellings is inserted between the grounding conductor plate 11B of the conducting material and the power supply circuit plate 12B carrying the power supply circuit pattern 14B including the power supply terminals 16B, and a second insulating sheet 17B2 carrying also the hollow swellings is inserted between the power supply circuit plate 12B and the radiation plate 13B having the apertures 15B. The first and second insulating sheets 17B1 and 17B2 comprise a plastic sheet formed to have on one side many swellings 20B1 and 20B2 in which air is tightly sealed, while these swellings 20B1 and 20B2 may be formed in the external form to be a circular truncated cone shape, circular cylindrical shape, spherical shape, dome shape, frustum-of-pyramid shape, square cylindrical shape or any other shape equivalent to them. In the planar antenna 10B for the linearly polarized waves formed with such sheets 17B1 and 17B2, as seen particular in FIG. 12, the respective swellings 20B1 and 20B2 are disposed between the grounding conductor plate 11B and the power supply circuit plate 12B and between the power supply circuit plate 12B and the radiation plate 13B, so as to function to optimumly separate these plates by a predetermined interval. In this arrangement, it will be readily appreciated that the first insulating sheet 17B1 may be so inserted as to abut top faces of the swellings 20B1 against the grounding conductor plate 11B, i.e., as turned over from the state of FIG. 12.

According to the instant embodiment, the use of the plastic sheet having the air-sealed swellings is effective to elevate the existing percentage of air between the respective grounding conductor plate, power supply circuit plate and radiation plate, i.e., effective to lower the existing percentage of the dielectric material, whereby the dielectric loss can be reduced and the antenna efficiency can be remarkably improved.

What is claimed is:

1. A planar antenna for linearly polarized waves, comprising a grounding conductor plate, a power supply circuit plate having thereon a power supply circuit pattern including power supply terminals and separated from said grounding conductor plate by a predetermined space so as to be insulated with respect to the grounding conductor plate with a layer of dielectric material interposed between the power supply circuit plate and the grounding conductor plate, and a radiation plate having therein apertures disposed as radiation elements respectively and electromagnetically coupled with each of said power supply terminals of said power supply circuit plate and disposed to be separated from the power supply circuit plate by a predetermined space so as to be insulated with respect to the power supply circuit plate with a layer of dielectric material interposed between the radiation plate and the power supply circuit plate, wherein said radiation plate comprises a metal plate of a thickness smaller than that of said layer of dielectric material between the radiation plate and the power supply circuit plate, and having said apertures which penetrate through said metal plate to be without any patch elements within and above a zone of said electromagnetic coupling, and said power supply terminals of said power supply circuit plate are disposed to terminate within a contour of the apertures in top plan view.

2. The antenna according to claim 1 wherein said apertures are formed in a square shape.

3. The antenna according to claim 1 wherein said apertures are formed in a circular shape.

4. The antenna according to claim 1 wherein said power supply circuit pattern of said power supply circuit plate includes portions in which power supplying conductor strips are made smaller in their width than that in other portions of the pattern, said smaller width portions being adjacent to said power supply terminals to be electromagnetically coupled to said apertures in said radiation plate.

5. The antenna according to claim 1 wherein said power supply terminals of said power supply circuit plate are disposed to extend beyond the center of said apertures in said radiation plate, in said top plan view.

6. The antenna according to claim 1 wherein said layer of dielectric material comprises a foamed plastic.

7. A planar antenna for linearly polarized waves, comprising a grounding conductor plate, a power supply circuit plate having thereon a power supply circuit pattern including power supply terminals and separated from said grounding conductor plate by a predetermined space so as to be insulated with respect to the grounding conductor plate with a layer of dielectric material interposed between the power supply circuit plate and the grounding conductor plate, and a radiation plate having therein apertures disposed as radiation elements respectively and electromagnetically coupled with each of said power supply terminals of said power supply circuit plate and disposed to be separated from the power supply circuit plate by a predetermined space so as to be insulated with respect to the power supply circuit plate with a layer of dielectric material interposed between the radiation plate and the power supply circuit plate, wherein said radiation plate comprises a metal plate of a thickness smaller than that of said layer of dielectric material between the radiation plate and the power supply circuit plate, and having said apertures which penetrate through said metal plate to be without any patch elements within and above a zone of said electromagnetic coupling, and said power supply terminals of said power supply circuit plate are disposed to terminate within a contour of the apertures in top plan view wherein said layer of dielectric material comprises a plastic sheet having thereon a plurality of swellings with air sealed therein and made to stand closely to each other.

* * * * *